US008045911B2

(12) United States Patent
Nishida

(10) Patent No.: US 8,045,911 B2
(45) Date of Patent: Oct. 25, 2011

(54) IMAGE FORMING APPARATUS HAVING A CLEANING SECTION

(75) Inventor: Satoshi Nishida, Saitama (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 772 days.

(21) Appl. No.: 12/057,455

(22) Filed: Mar. 28, 2008

(65) Prior Publication Data

US 2008/0304884 A1 Dec. 11, 2008

(30) Foreign Application Priority Data

Jun. 7, 2007 (JP) ..... 2007-151435

(51) Int. Cl.
*G03G 21/00* (2006.01)
*G03G 15/00* (2006.01)

(52) U.S. Cl. ..... 399/349; 399/71

(58) Field of Classification Search ..... 399/349, 399/345, 71

See application file for complete search history.

(56) References Cited

U.S. PATENT DOCUMENTS

| | | | | |
|---|---|---|---|---|
| 5,463,455 | A * | 10/1995 | Pozniakas et al. | 399/350 |
| 6,438,337 | B1 * | 8/2002 | Abe | 399/71 |
| 2002/0009316 | A1 * | 1/2002 | Endo et al. | 399/349 |
| 2006/0210334 | A1 * | 9/2006 | Tokumasu et al. | 399/346 |
| 2006/0269329 | A1 * | 11/2006 | Honda et al. | 399/227 |
| 2007/0166087 | A1 * | 7/2007 | Yamaguchi et al. | 399/346 |

FOREIGN PATENT DOCUMENTS

| | | | |
|---|---|---|---|
| JP | 08006451 A | * | 1/1996 |
| JP | 10-254323 A | | 9/1998 |

* cited by examiner

*Primary Examiner* — David Gray
*Assistant Examiner* — Billy J Lactaoen
(74) *Attorney, Agent, or Firm* — Buchanan Ingersoll & Rooney PC

(57) ABSTRACT

An image forming apparatus, including an image carrier, a toner image forming section which forms a toner image on the image carrier, a transfer section which transfers the toner image formed on the image carrier to an intermediate transfer member or a recording sheet, a cleaning section which includes a brush and a blade to remove toner particles remaining on the image carrier after the toner image are transferred by the transfer section, and a control section executes a blade cleaning mode in which toner particles having an opposite polarity against the toner particles adhered onto the blade are sent to the cleaning section while an amount of toner particles to be removed by the brush is changed.

19 Claims, 8 Drawing Sheets

IMAGE FORMING APPARATUS HAVING A CLEANING SECTION

CROSS REFERENCE TO RELATED APPLICATION

This application is based on Japanese Patent Application No. 2007-151435 filed on Jun. 07, 2007 with the Japanese Patent Office, the entire content of which is hereby incorporated by reference.

FIELD OF THE INVENTION

The present invention relates to an image forming apparatus, such as a copier, a printer and a facsimile, using the electro-photographic technology, and in particular, to an image forming apparatus, characterizing a cleaning process which removes any residual toner particles remaining on the surface of a photoconductor, after toner images have been transferred.

BACKGROUND OF THE INVENTION

In image forming apparatuses, such as copiers, printers and facsimile devices, using the electro-photographic technology, a latent image is formed on the evenly charged surface of a photoconductor by a scanning exposure of an exposure device, such as laser beams.

Said latent image is developed to be a toner image on the photoconductor, and said formed toner image is transferred onto a supporting member, such as an intermediate transfer member or a sheet of recording media, by the function of an electrical field and electrical current which are produced between the transfer member and the photoconductor.

However, it is almost impossible for the image forming apparatus that the toner image formed on the photoconductor is completely transferred onto the supporting member, such as an intermediate transfer member or a sheet of recording media, whereby a small amount of toner particles remains on the photoconductor after the transfer process is completed. In order to remove said residual toner particles on the photoconductor, the cleaning section is provided.

Most cleaning sections have a rotating brush which removes any residual toner remaining on the surface of the photoconductor, and a blade which wipes any remaining toner which still remains after the brushing rotation.

Unexamined Japanese Patent Application Publication No. 10-254,323 discloses that while the rotating brush rotates, it contacts the surface of the photoconductor to remove any residual toner remaining after the transfer operation. Accordingly, the rotating speed is controlled so as not to damage the surface of the photoconductor, nor to firmly fix the toner onto the surface of the photoconductor, due to rubbing on the surface of the photoconductor.

The above blade is generally formed of an elastic resin, such as a polyurethane type resin, whereby its cutting part faces against the moving direction of the surface of the photoconductor, and a surface adjacent to the cutting part is arranged to contact the photoconductor.

Since the blade scrapes the photoconductor through a certain contacting area (hereinafter referred to as a "nipping section"), the blade is electrically charged due to rubbing with the photoconductor.

If the blade, charged to be a certain polarity, contacts any toner particles, which carries polarity opposite that of the blade, said toner particles are captured by the electrostatic force of the blade, and are gradually accumulated.

The accumulated toner particles are shifted to the photoconductor which touches the blade, and are firmly adhered to the surface of the photoconductor. This adhered toner causes further adhesion of toner particles or an external additive, onto the surface of the photoconductor.

Adhered particles, due to the above procedure on the photoconductor, interrupt the exposure process of forming the latent image, so that electrical potential cannot be changed by the exposure on the evenly charged the photoconductor where the adhered particles exist.

Accordingly, toner particles do not adhere onto the section where the adhered particles exist, whereby white spots appear on a developed image as a void image. Such phenomenon is well known as a defect of images, which is sometime called "exclamation mark".

SUMMARY OF THE INVENTION

The present invention has been achieved to overcome the above problem, and an object of the present invention is to provide an image forming apparatus, including a cleaning section which removes any residual toner particles by a blade and a brush, remaining on the photoconductor after the toner image transfer operation, wherein the toner particles accumulated on the blade are quickly removed, preventing more from being adhered onto the photoconductor, and defective images are prevented from being generated.

The object can be attained by the items described below.

Item 1. An image forming apparatus, including:

an image carrier;

an image forming section which forms a toner image on the image carrier;

a transfer section which transfers the toner image formed on the image carrier to an intermediate transfer member or a recording sheet;

a cleaning section which includes a brush and a blade to remove toner particles remaining on the image carrier after the toner image are transferred by the transfer section; and a control section executes a blade cleaning mode in which toner particles having an opposite polarity against the toner particles adhered onto the blade are sent to the cleaning section while an amount of toner particles to be removed by the brush is changed.

Item 2. An image forming apparatus, including:

an image carrier;

an image forming section which forms a toner image on the image carrier;

a transfer section which transfers the toner image formed on the image carrier to an intermediate transfer member or a recording sheet;

a cleaning section which includes a brush and a blade to remove toner particles remaining on the image carrier after the toner image are transferred by the transfer section; and a control section executes a blade cleaning mode in which toner particles having the same polarity as the toner particles adhered onto the blade are sent to the cleaning section while an amount of toner particles to be removed by the brush is changed.

DETAILED DESCRIPTION OF THE INVENTION

Figure 1:
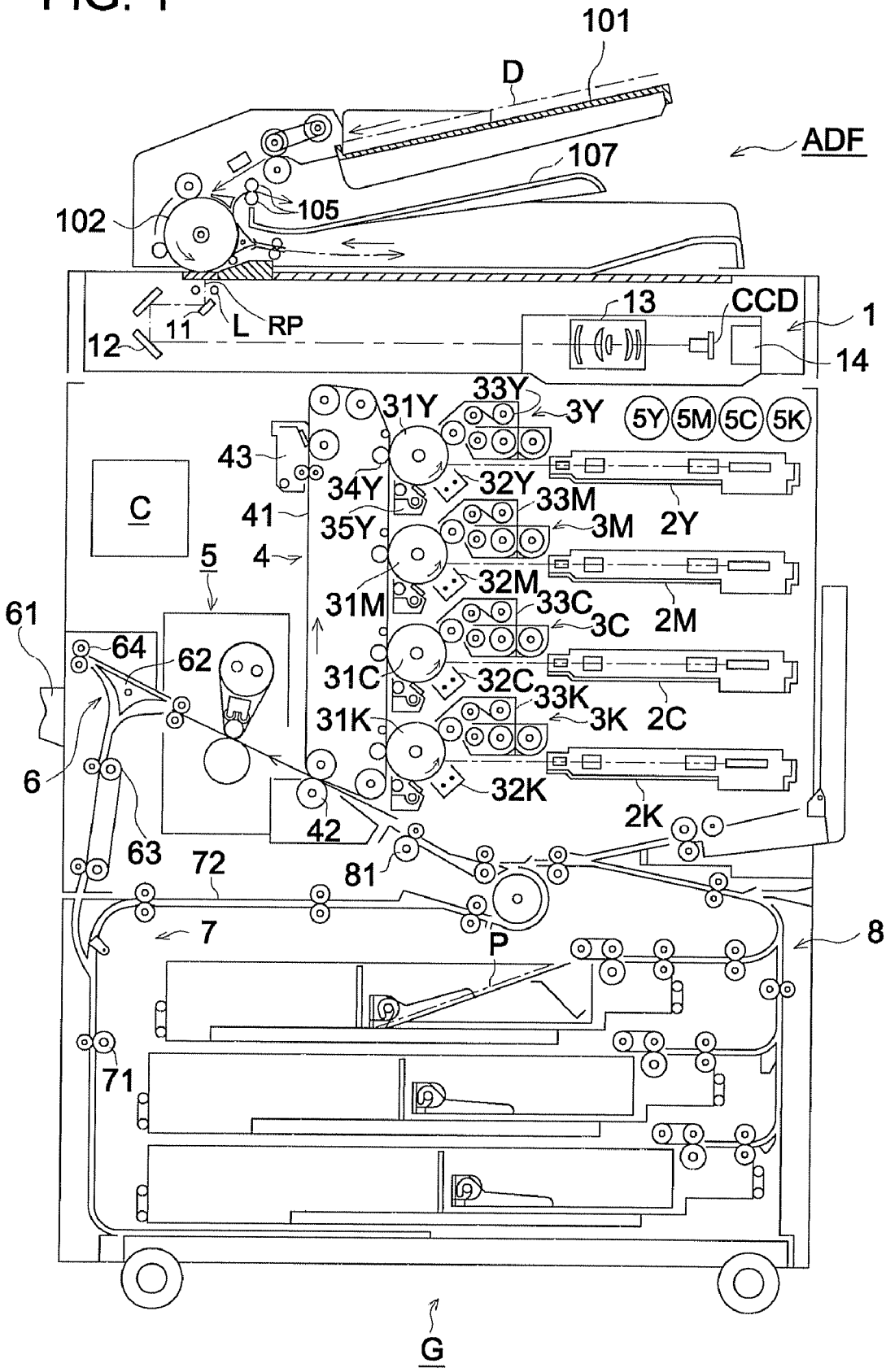
FIG. 1 is a total view of the image forming apparatus.

Embodiments of the present invention will now be detailed while referring to the drawings.

FIG. 1 is a total view of image forming apparatus G, which is a tandem type color image forming apparatus, including a plurality of the photoconductors, serving as image carriers, each vertically arranged facing an intermediate transfer member to form a full color image.

Image forming apparatus G has automatic document feeding device ADF on its top surface.

Original document D, placed on document platen 101 of automatic document feeding device ADF, is conveyed one by one into a document conveyance path, and is partially conveyed by conveyance drum 102.

During conveyance of original document D, the image carried by original document D is read by document reading section 1 at document image reading position RP. After the image has been read, original document D is ejected onto document ejection plate 107 by first conveyance guide G1 (which is not illustrated) and paired document ejection rollers 105.

Image forming apparatus G is structured of document reading section 1, image writing sections 2Y, 2M, 2C and 2K, image forming sections 3Y, 3M, 3C and 3K, intermediate transfer section 4, fixing device 5, reversed sheet ejection section 6, sheet re-supplying section 7, sheet supplying section 8, and control section C.

Document reading section 1 radiates light rays onto the image carried on original document D from lamp L, and guides reflected light rays from document D by first mirror unit 11, second mirror unit 12, and lens 13, to concentrate the reflected light rays onto the light receiving surface of image pickup device CCD.

Image signals, photo-electrically converted by image pickup device CCD, are processed by image reading control section 14 with respect to A/D convergence, shading correction, and image compression, which are then stored in memory M of control section C as image data.

Said image data, stored in memory M, are appropriately processed, based on conditions set by the user, and which are then generated to be outputted image data.

Each of image writing sections 2Y, 2M, 2C and 2K is structured of a laser light source, a polygonal mirror, and a plurality of lenses, which together generate a laser beam.

Said image writing sections 2Y, 2M, 2C and 2K conduct scanning exposure on the surfaces of the photoconductors 31Y, 31M, 31C and 31K, which are structuring members of image forming sections 3Y, 3M, 3C and 3K, respectively, by said generated laser beams.

Due to said scanning exposure of the laser beams, latent images are generated on the photoconductors 31Y, 31M, 31C and 31K.

Main charging section 32Y, developing device 33Y, first transfer roller 34Y and cleaning section 35Y are arranged around photoconductor 31Y. Devices and sections, which are the same way as a case of photoconductor 31Y, are also arranged around the photoconductors 31M, 31C and 31K. These structures are well-known in the field of color image forming apparatuses.

The latent images, formed on the photoconductors 31Y, 31M, 31C and 31K, are developed by developing device 33Y, 33M, 33C and 33K, respectively, so that a toner image is formed on each the photoconductor.

Said toner images, formed on the photoconductors 31Y, 31M, 31C and 31K, are sequentially transferred to a prescribed position of intermediate transfer belt 41, which serves as an intermediate transfer member, by first transfer rollers 34Y, 34M, 34C and 34K of intermediate transfer section 4.

After the transfer operations are completed, any residual toner particles on the surfaces of the photoconductors 31Y, 31M, 31C and 31K are removed by cleaning sections 35Y, 35M, 35C and 35K, respectively.

Said toner image transferred onto intermediate transfer belt 41 is transferred by paired second transfer rollers 42 onto recording sheet P, serving as a transfer member, which has been synchronously conveyed in an appropriate timing by paired sheet supplying rollers 81.

After the toner image has been transferred onto recording sheet P, the surface of intermediate transfer belt 41 is cleaned by cleaning section 43, and works for the next image transfer operation.

Sheet P, carrying the toner image, is conveyed to fixing device 5, and heat-pressured so that the toner image is fixed onto sheet P as a permanent image.

After the fixing operation has been completed by fixing device 5, sheet P is conveyed by sheet reversing section 6 to be ejected onto sheet ejection plate 61. When sheet P is to be ejected, after it has been reversed, sheet P is guided downward by sheet ejection guide 62, and the trailing edge of sheet P is nipped by paired reversing rollers 63, said rollers are subsequently reversed, so that sheet P is guided back to sheet ejection rollers 64 by sheet ejection guide 62, and ejected onto sheet ejection plate 61.

When image formation is to be conducted on the rear surface of sheet P, after an image has been fixed on the front surface of sheet P, sheet P is conveyed downward to re-supplying section 7 by sheet ejection guide 62, whereby the trailing edge of sheet P is nipped by paired re-supplying reversing rollers 71, and which are subsequently reversed so that reversed sheet P is conveyed to re-supplying conveyance path 72, in preparation to form an image on the rear surface.

Figure 2:
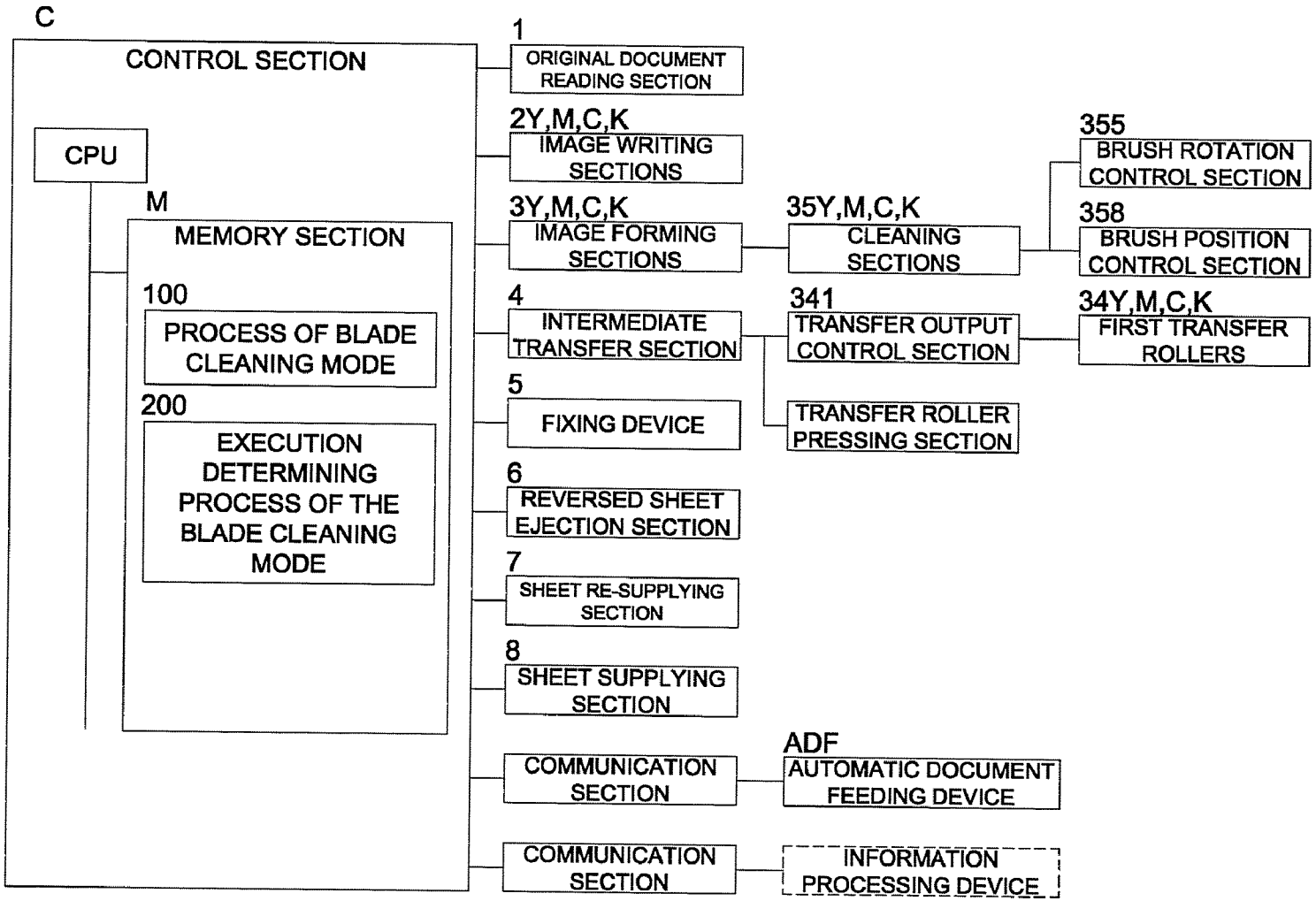
FIG. 2 is a block diagram to show a control system of the image forming apparatus.

FIG. 2 is a block diagram showing the control system of image forming apparatus G.

Control section C of image forming apparatus G is a computer system which has CPU, memory M, I/O ports, communication interfaces, and circuits for driving each section, and which conducts various controls through executing programs stored in memory M.

Automatic document feeding device ADF, having a similar computer system but smaller, can communicate information with control section C through communication sections.

In addition, any blocks in the diagram of FIG. 2 which are not related to the explanation of the present invention are not explained.

Figure 3:
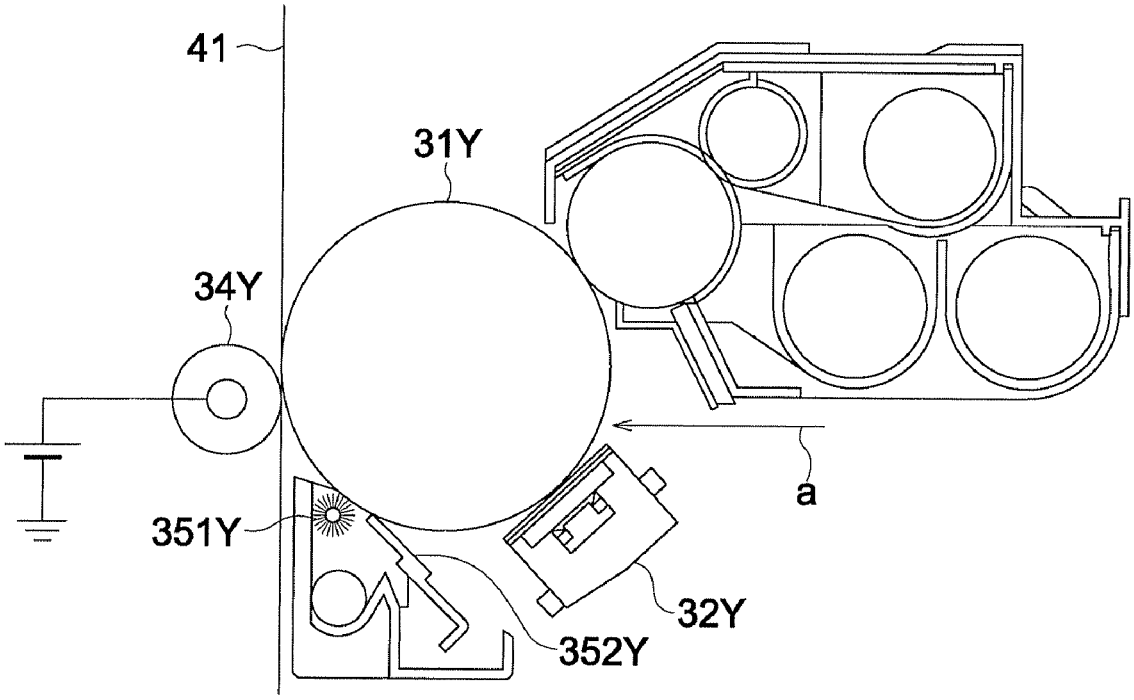
FIG. 3 PRIOR ART
FIG. 3 is a schematic view showing a transfer roller and a cleaning section of a conventional image forming apparatus.

FIG. 3 is a schematic view to explain first transfer roller 34Y and cleaning section 35Y of the conventional image forming apparatus. Since the same structure in FIG. 3 is used for Y, M, C and K systems, only the explanation for Y, which is the system of the yellow color, will be given.

On photoconductor 31Y, which is evenly charged by main charging section 32Y, latent images are formed by the scanning exposure of the laser beam, shown by arrow "a", of image writing section 2Y.

In the present embodiment, an OPC (which is an organic photoconductor) is used for the photoconductor, to form the latent image by the scanning exposure of the laser beam. Generally in this structure, the surface of photoconductor 31Y carries a uniform negative charge.

The latent images on photoconductor 31Y whose electrical charge has been erased by the scanning exposure of the laser beam, are developed by developing device 33Y, so that toner images, formed of negatively-charged toner particles, are produced on photoconductor 31Y.

Said toner images on photoconductor 31Y are transferred onto intermediate transfer belt 41, which serves as an intermediate transfer member, by first transfer roller 34Y which serves as a transfer section of intermediate transfer section 4.

Said first transfer roller 34Y, which serves as the transfer section, is for example, an electrically conductive sponge roller at a diameter of 22 mm, and includes a cored metal rod at a diameter of 8 mm. During the normal transfer operation of the image, said first transfer roller 34Y presses intermediate transfer belt 41 against photoconductor 31Y, but it does not, during an idling time.

While first transfer roller 34Y does not press intermediate transfer belt 41 against photoconductor 31Y, intermediate transfer belt 41 is not in contact with photoconductor 31Y.

Further, during the image transfer operation, positive bias voltage is applied onto first transfer roller 34Y so that a transfer current of 50 μA passes from first transfer roller 34Y to photoconductor 31Y.

Accordingly, the toner particles, which exist on photoconductor 31Y which has been negatively charged, are attracted toward first transfer roller 34Y, which are positive against photoconductor 31Y, whereby toner images are transferred onto intermediate transfer belt 41.

Any toner particles, remaining on the surface of photoconductor 31Y after the image transfer operation, are removed from the surface, by brush 351Y and blade 352Y of cleaning section 35Y.

Figure 4:
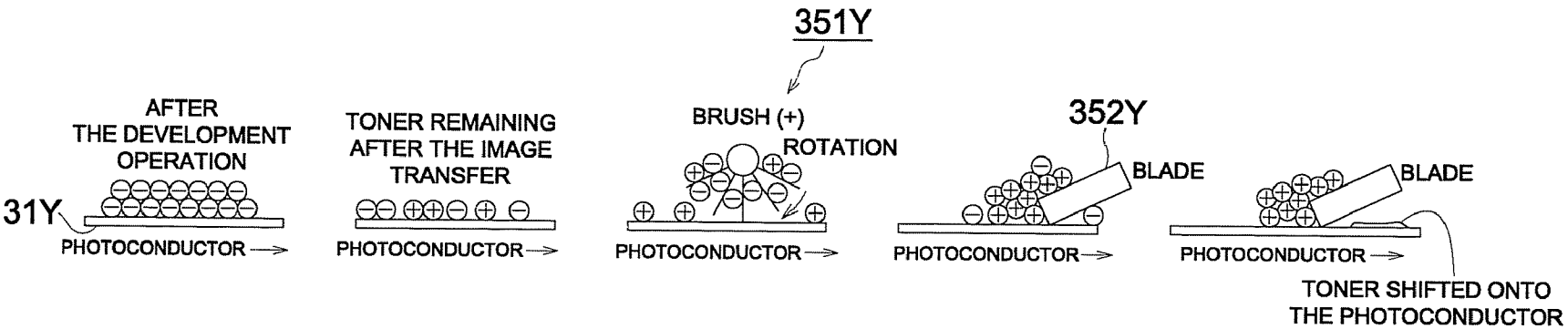
FIG. 4(*a*)-(*e*) are drawings to detail the mechanism in which the residual toner particles after the transfer operation, are accumulated on the blade.

FIG. 4 is a drawing to detail the mechanism in which the remaining toner particles after the transfer operation accumulate on blade 352Y.

As described above, due to the scanning exposure conducted by writing section 2Y, the negative charge is erased from the scanning-exposed surface of evenly charged photoconductor 31Y. The toner particles, which were negatively charged by developing section 33Y, adhere onto the area where the electrical charge was erased [see FIG. 4(*a*)].

The toner particles, formed on photoconductor 31Y, are moved toward first transfer roller 34Y, due to the electrical charge which is formed between first transfer roller 34Y, carrying the positive bias voltage against photoconductor 31Y, and photoconductor 31Y. The toner image, formed of the negatively charged toner particles on photoconductor 31Y, is transferred onto intermediate transfer belt 41, which exists between photoconductor 31Y and first transfer roller 34Y.

After the toner image is transferred, a small amount of toner particles remain on the surface of photoconductor 31Y. In addition, the polarity of some remaining toner particles has been reversed to positive by the electrical field formed between first transfer roller 34Y and photoconductor 31Y [see FIG. 4(*b*)].

Among the remaining toner particles, the negatively charged toner particles are wiped from the surface of photoconductor 31Y by brush 351Y having wires which are positively charged against photoconductor 31Y, and wiped toner particles temporarily adhere to brush 351Y [see FIG. 4(*c*)].

On the other hand, any positively charged toner particles and any negatively charged toner particles slipping through brush 351Y are stopped by blade 352Y which is arranged downstream of brush 351Y in the moving direction of the photoconductor's surface [see FIG. 4(*d*)].

Generally, blade 352Y is formed of an elastic resin, such as a polyurethane type resin, and since said blade 352Y always slides on photoconductor 31Y, blade 352Y is negatively charged.

Accordingly, some of the positively charged remaining toner particles, which have slipped through said brush 351Y and further advanced, are electrostatically attracted by negatively charged blade 352Y, so that said attracted toner particles gradually accumulate on blade 352Y [see FIG. 4(*e*)].

Figure 5:
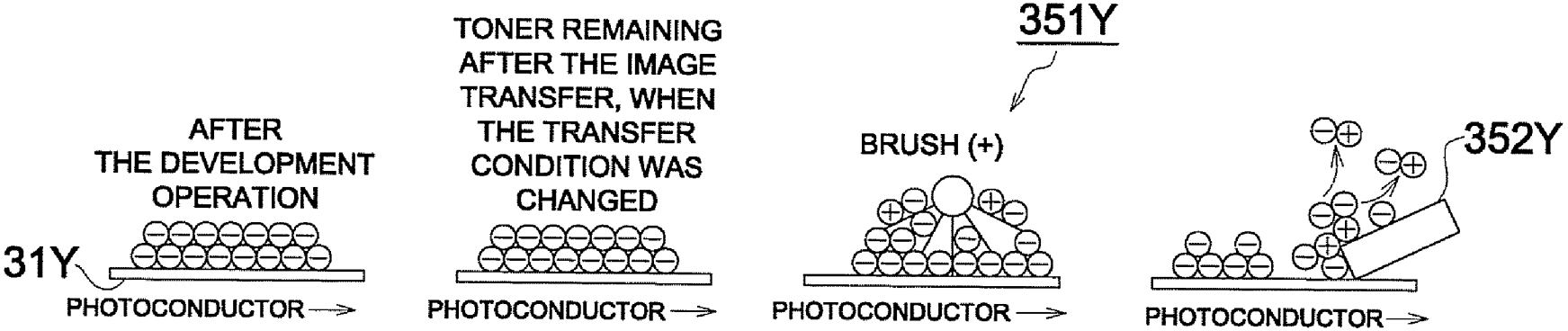
FIG. 5(*a*)-(*d*) are drawings to detail the mechanism of the present invention in which the residual toner particles remaining after the transfer operation are separated from the blade.

FIG. 5 is a drawing to detail the mechanism of the present invention in which any toner particles, remaining on blade 352Y after the transfer operation, are separated from blade 352Y.

In the present invention, a toner image is initially formed on photoconductor 31Y [see FIG. 5(*a*)].

Next, the bias voltage applied onto first transfer roller 34Y is changed, for example, it is changed to 0 volt, or is lowered, or its polarity is changed.

Further, during normal transferring operation of the image, the position of first transfer roller 34Y is changed, which was previously positioned to press intermediate transfer belt 41 against photoconductor 31Y.

For example, during the present operation, while pressure is released, intermediate transfer belt 41 has not been in contact with photoconductor 31Y.

Like the above change of setting of first transfer roller 34Y, the toner image whose toner particles were negatively charged on photoconductor 31Y, is not transferred onto intermediate transfer belt 41, but moves with photoconductor 31Y [see FIG. 5(*b*)].

The remaining toner particles, which were not transferred but remained on photoconductor 31Y, are mostly sent to blade 352Y, by the rotation of brush 351Y and the change of distance between brush 351Y and photoconductor 31Y [see FIGS. 5(*c*) and 5(*d*)].

As a consequence, most of the negatively charged toner particles reach blade 352Y, and come into contact with toner particles which have been positively charged and accumulated on blade 352Y, as detailed in FIG. 4. Accordingly, the positively charged toner particles, which have been accumulated on blade 352Y, are electrically neutralized so that the electro-statistic attracting force between blade 352Y and the accumulated toner particles is eliminated.

That is, most toner particles which carry the same polarity as blade 352Y, (which is a negative polarity) are conveyed to blade 352Y, so that the toner particles, carrying a positive polarity accumulated on blade 352Y are capable to be neutralized.

Due to the elimination of said electrostatic attracting force, the toner particles accumulated on blade 352Y are easily separated from blade 352Y, and stored in a prescribed position of cleaning section 35Y.

Accordingly, the positively charged toner particles are accumulated on blade 352Y, whereby said accumulated toner particles are prevented from moving toward photoconductor 31Y.

Figure 6:
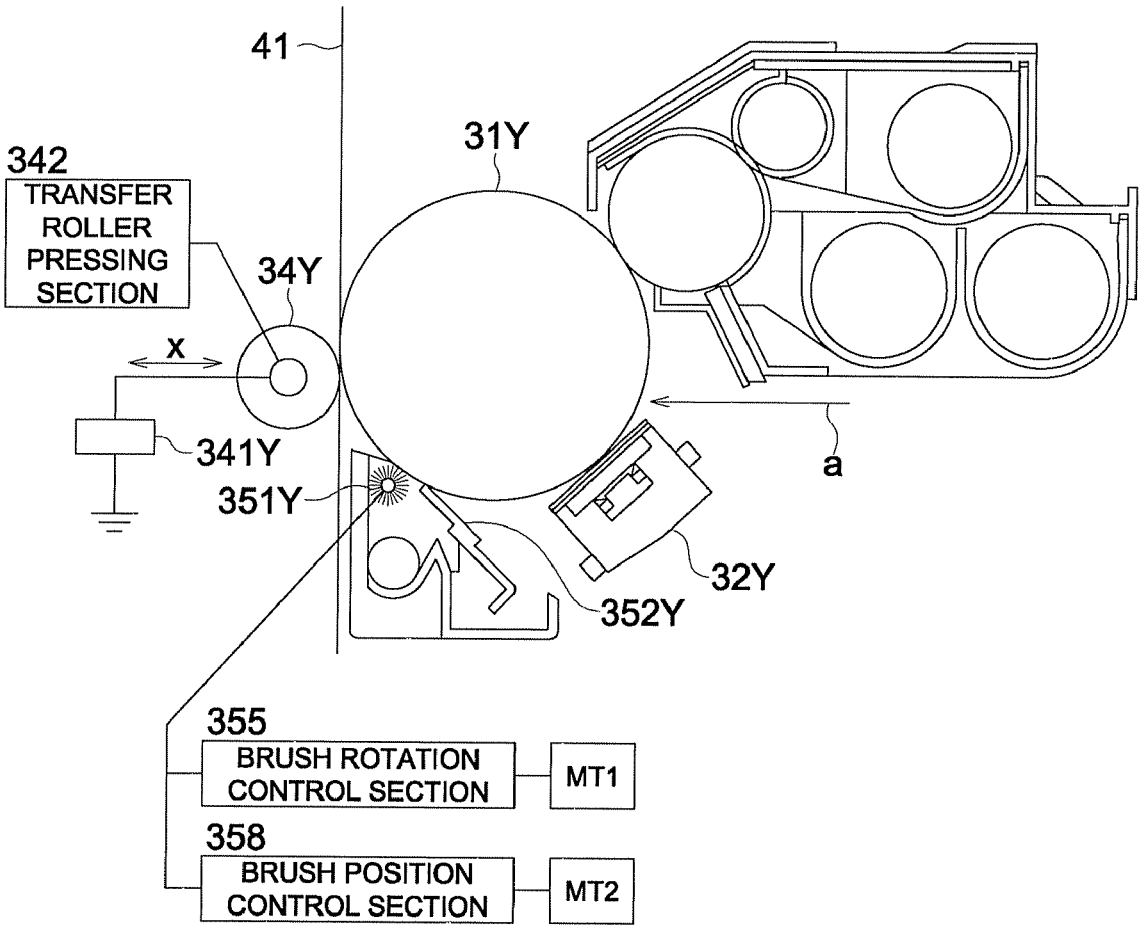
FIG. 6 is a block diagram to detail main structuring sections of the present invention.

FIG. 6 is a block diagram to detail main structuring sections of the present invention.

As the same as in the conventional example, first transfer roller 34Y is a 22 mm diameter electro-conductive sponge roller, whereby bias voltage is applied onto a 8 mm diameter core, included within first transfer roller 34Y. In addition, an aluminum tube which is a base body of photoconductor 31Y is electrically grounded.

Control section C controls transfer output control section 341Y, whereby the control of said bias voltage is conducted.

For example, while the image is being transferred, a transfer current of 50 μA passes from first transfer roller 34Y, serving as a transfer section, to photoconductor 31Y through intermediate transfer belt 41. Further, in order to prevent the image from being transferred onto intermediate transfer belt 41, the direction of said transfer current is controlled to be reduced or reversed, or the transfer current is controlled to be zero, so that the output of the transfer section is stopped.

Further, said first transfer roller 34Y is moved in either direction as shown by double-headed arrow X in FIG. 6, controlled by transfer roller pressing section 342, whereby intermediate transfer belt 41 is controlled to press against photoconductor 31Y, or to retract from photoconductor 31Y.

Brush 351Y is one on which plural hairs are imbedded in a spiral manner on a cored shaft, control section C controls motor MT1 of brush rotation control section 355 to stop the rotation or to change the direction of rotation.

Still further, control section C controls motor MT2 to rotate an eccentric cam (which is not illustrated) of brush position control section 358, so that the distance between brush 351Y and photoconductor 31Y can be changed.

Figure 7:
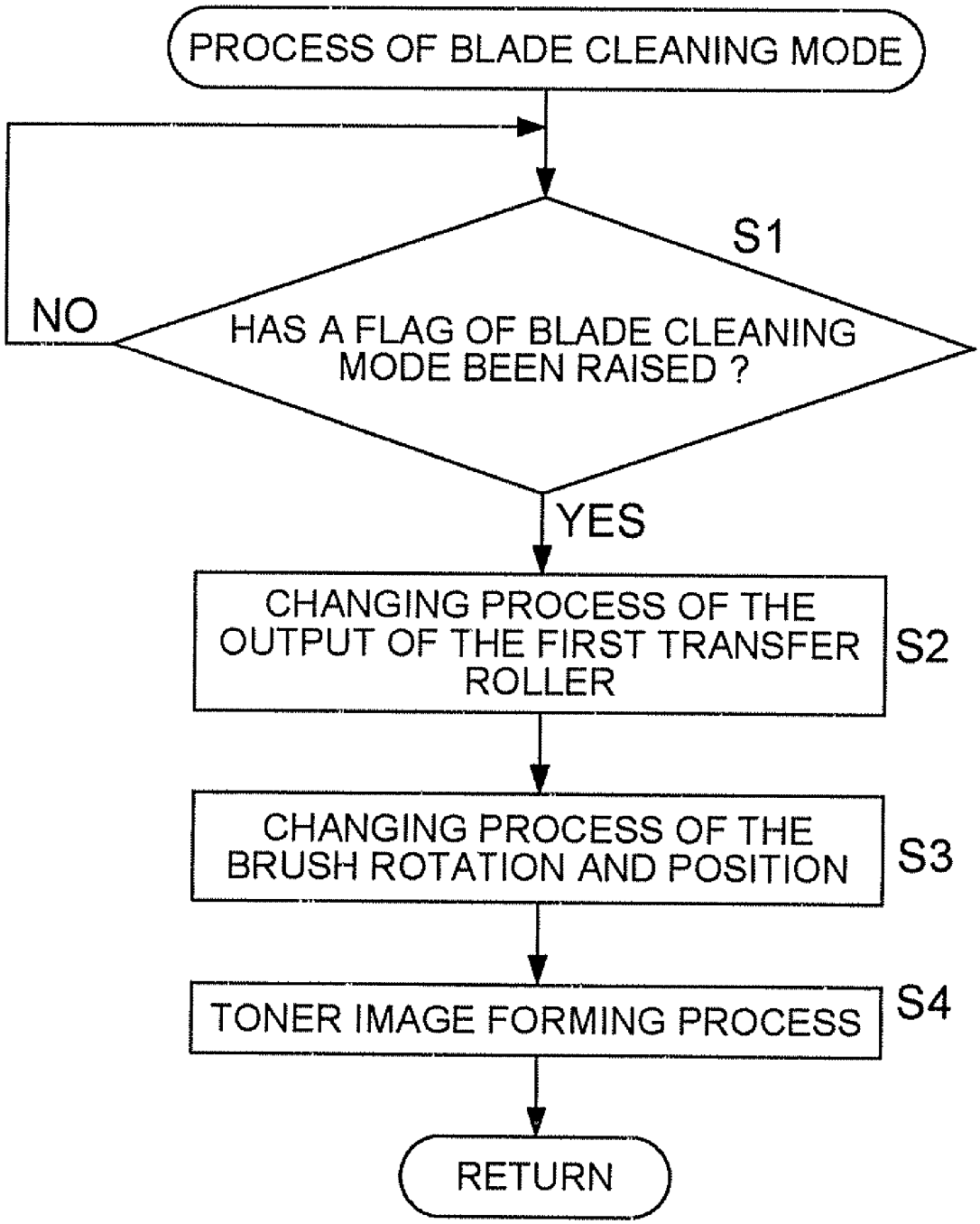
FIG. 7 is a flow chart to show a process flow of a blade cleaning mode.

FIG. 7 is a flow chart to show blade cleaning mode process 100, to control first transfer roller 34Y and cleaning roller 351Y, when the blade cleaning mode is started.

When a blade cleaning flag is established to indicate starting of the blade cleaning mode (Yes of step S1), the setting of transfer output control section 341 is changed, which controls the output of first transfer roller 34Y, serving as the transfer section (step S2).

Said changing operation of the settings of transfer output control section 341 is conducted, that is, said settings conduct any one of: stopping the output voltage, changing the magnitude of output voltage, changing the magnitude of output current, and changing of polarity of the output, whereby selection and magnitude of voltage or current is determined by experiments.

That is, transfer output control section 341 helps the toner particles on the photoconductor move to the cleaning section, while the toner particles are not transferred, by the stop of transfer outputting or the reduction of the transfer current. Further, transfer output control section 341 controls the toner particles on the photoconductor to increase their electrical charge as the output polarity, by using the transfer current which carries the same polarity as the toner particles.

When the changing operation of the settings is completed for transfer output control section 341, setting of brush rotation control section 355 is changed so that the rotating velocity and the direction of rotation of brush 351Y are changed, and the setting of brush position control section 358 is changed so that the distance between brush 351Y and photoconductor 31Y is changed (step S3).

Due to the changing operation of the settings of brush rotation control section 355, at least one among the following actions is conducted: stopping rotation of brush 351Y, changing rotation speed, and changing rotation direction. Selection of them and the rotation velocity to be set are determined by experiments.

Due to the setting operation of the setting of brush position control section 358, the distance between brush 351Y and photoconductor 31Y is changed, so that the force of brush 351Y pressing against the surface of photoconductor 31Y is changed. Further, if the distance is sufficiently increased, any toner particles adhered onto the surface of photoconductor 31Y cannot contact brush 351Y.

The changing operation of the settings of brush rotation control section 355, and the changing operation of the settings of brush position control section 358, both detailed above, are operated for the purpose of changing the capability of removing the toner particles on photoconductor 31Y, and due to said changing operations, the amount of toner particles reaching blade 352Y is changed.

Accordingly, in the blade cleaning mode, both brush rotation control section 355 and brush position control section 358 control the brush to reduce the amount of toner particles to be removed, or control the brush to stop the removing operation of toner particles, whereby the toner particles can be reliably conveyed to the cleaning blade.

When the change of rotation and the change of position of brush 351Y have been completed, a digital image, which was previously stored in the memory and which will be used to clean the blade, is formed as a toner image on photoconductor 31Y (step S4), then the routine for this procedure shown in FIG. 7 is completed.

Said toner image to clean the blade formed on photoconductor 31Y is provided to be sent to cleaning section 35Y, while being not transferred onto intermediate transfer belt 41. The density and size of the image for cleaning the blade is determined based on the amount of toner particles to be sent to cleaning section 35Y.

Further, the relationship between the amount of toner particles to be sent and the density and size of the image to be formed is previously determined by experiment.

Figure 8:
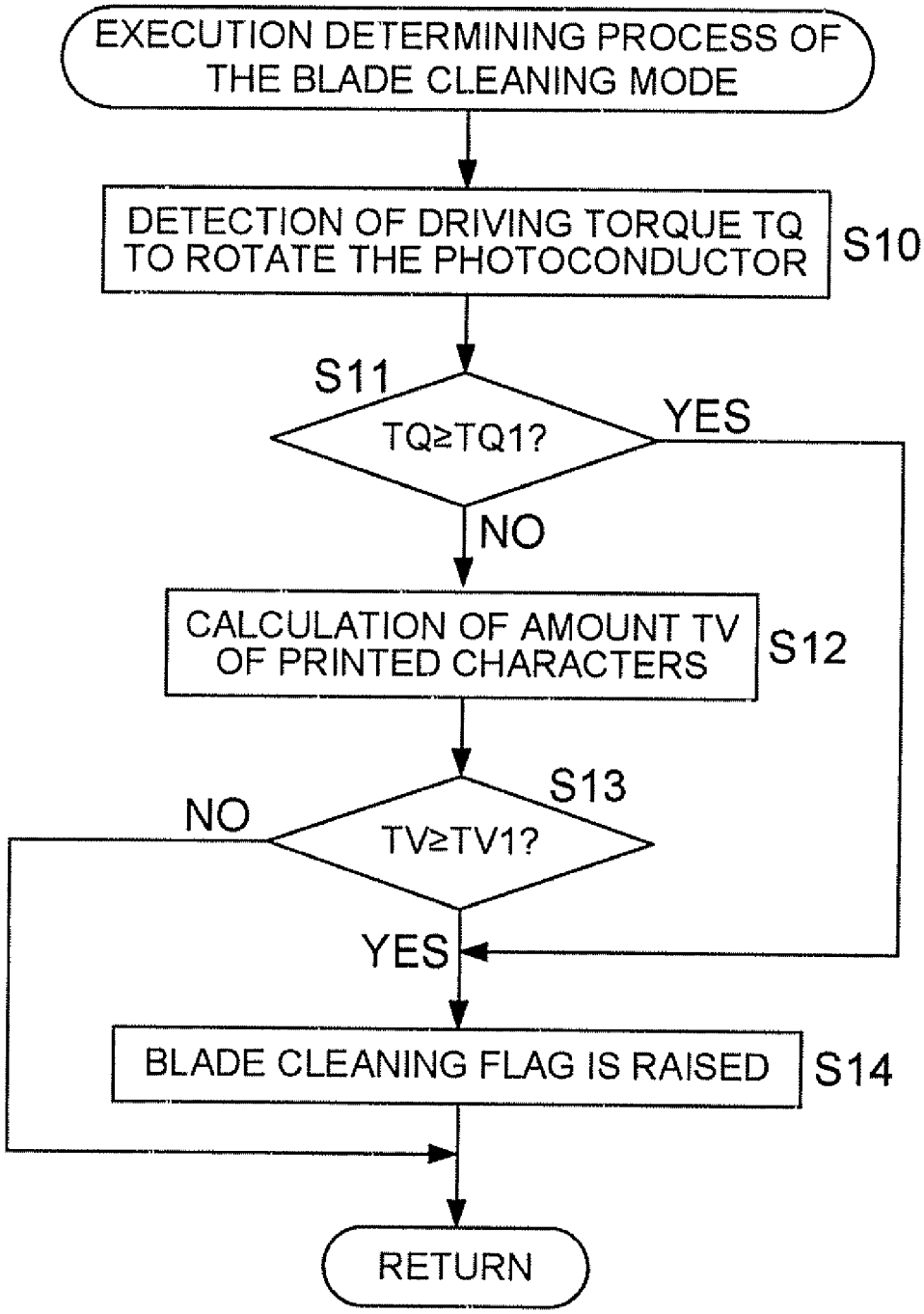
FIG. 8 is a flow chart to show a process to determine the execution of the blade cleaning mode.

FIG. 8 is a flow chart to show a process to determine the execution of the blade cleaning mode, which determines the timing for entering the blade cleaning mode.

Firstly, after a driving current to drive a motor (being not illustrated) which drives photoconductor 31Y, is measured, output torque TQ (which is torque TQ to rotate the photoconductor) of the motor is calculated based on the said measured current (step S10).

When toner particles have accumulated on brush 352Y, the burden for the motor increases, that is, load torque TQ for the motor increases. By this relationship, an amount of toner accumulated on blade 352Y can be determined based on the change of load torque TQ.

If load torque TQ is equal to or greater than preset value TQ1 ("Yes" in step S11), a blade cleaning flag is established to enter the blade cleaning mode (step S14), and the routine for this procedure shown in FIG. 8 is completed.

If load torque TQ is less than preset value TQ1 ("NO" in step S1), text printed value TV is calculated based on a coverage rate of printed images and the number of outputted sheets (step S12).

That is, based on text printed value TV, the provable amount of toner particles accumulated on blade 352Y is calculated.

If calculated print amount TV is equal to or greater than preset value TV1 ("YES" in step S13), a blade cleaning flag is established to admit the execution of the blade cleaning mode (step S14), and the steps of the procedure shown in FIG. 8 are completed.

If calculated text printed value TV is less than preset value TV1 ("NO" in step S13), the steps of the procedure shown in FIG. 8 is completed.

Further, the relationship between the text printed value and the amount of toner accumulated on blade 352Y, that is, the relationship of the coverage rate, the number of outputted sheets, and the amount of toner particles accumulated on blade 352Y, has been obtained by the experiment, which were previously stored in memory M as a formula or a table.

Based on the above obtained relationship, the amount of toner particles accumulated on blade 352Y is calculated.

The calculation of the amount of toner particles accumulated on blade 352Y is not limited to the above example, that is, the calculation can also be conducted based on an amount which is proportional to the amount of toner particles remaining after the transfer operation, such as an amount of toner particles included within brush 351Y and a rate of content of toner particles.

Further, by adding a condition in which the blade cleaning flag is established only when image forming apparatus G is under an idling condition, the blade cleaning mode can be executed during the idling mode of image forming apparatus G.

Based on the present embodiment describe above, the toner particles, remaining on the surface of the photoconductor after the toner image transfer operation, are prevented from accumulating on the blade of the cleaning section. Accordingly, the toner particles accumulated on the blade do not shift to the photoconductor, so that an image forming apparatus can be realized, which rarely produces the white spots (being exclamation marks) in images, preventing the images from deteriorating the quality.

What is claimed is:

1. An image forming apparatus, comprising:

an image carrier;

a toner image forming section which forms a toner image on the image carrier;

a transfer section having a transfer output, wherein the transfer section transfers the toner image formed on the image carrier to an intermediate transfer member or a recording sheet;

a cleaning section which includes a blade to remove toner particles remaining on the image carrier after the toner image is transferred by the transfer section, wherein toner particles having a first polarity are adhered on the blade after the toner image is transferred by the transfer section; and a control section which executes a blade cleaning mode after the toner image is transferred by the transfer section, wherein the control section controls the transfer output to allow toner particles having a second polarity to remain on the image carrier to be delivered to the blade, wherein the controlled transfer output is stopped as changing a setting of the transfer output, wherein the first polarity and second polarity are opposite in electric charge.

2. The image forming apparatus of claim 1, wherein the cleaning section further includes a brush, wherein in the blade cleaning mode, the control section rotates the brush to conduct a removal operation of the toner particles and decreases the amount of toner particles to be removed, or controls the brush to stop the removal operation of the toner particles.

3. The image forming apparatus of claim 2, wherein the control section changes a distance between the brush and the image carrier in the blade cleaning mode.

4. The image forming apparatus of claim 3, wherein the brush is controlled not to contact a surface of the image carrier by changing the distance between the brush and the image carrier.

5. The image forming apparatus of claim 3, wherein a force of the brush to contact the surface of the image carrier is changed by changing the distance between the brush and the image carrier.

6. The image forming apparatus of claim 2, wherein the control section stops a rotation of the brush in the blade cleaning mode.

7. The image forming apparatus of claim 2, wherein in the blade cleaning mode, the control section changes a rotation speed or a rotation direction of the brush.

8. The image forming apparatus of claim 1, wherein the control section determines whether the blade cleaning mode is to be selected or not, based on a coverage rate of the toner image formed on the image carrier or a number of the formed toner image.

9. An image forming apparatus, comprising:

an image carrier;

a toner image forming section which forms a toner image on the image carrier;

a transfer section having a transfer output, wherein the transfer section transfers the toner image formed on the image carrier to an intermediate transfer member or a recording sheet;

a cleaning section which includes a blade to remove toner particles remaining on the image carrier after the toner image is transferred by the transfer section, wherein toner particles having a first polarity are adhered on the blade after the toner image is transferred by the transfer section;

a control section which executes a blade cleaning mode after the toner image is transferred by the transfer section, wherein the control section controls the transfer output to allow toner particles having a second polarity to remain on the image carrier to be delivered to the blade, wherein the first polarity and the second polarity are opposite in electric charge; and a torque detecting section which detects a loading torque of a driving section which rotates the image carrier, wherein the control section determines whether the blade cleaning mode is to be selected or not based on an information detected by the torque detecting section.

10. The image forming apparatus of claim 9, wherein the cleaning section further includes a brush, wherein in the blade cleaning mode, the control section rotates the brush to conduct a removal operation of the toner particles and decreases the amount of toner particles to be removed by the brush, or controls the brush to stop the removal operation of the toner particles.

11. The image forming apparatus of claim 10, wherein the control section changes a distance between the brush and the image carrier in the blade cleaning mode.

12. The image forming apparatus of claim 11, wherein the brush is controlled not to contact a surface of the image carrier by changing the distance between the brush and the image carrier.

13. The image forming apparatus of claim 11, wherein a force of the brush to contact the surface of the image carrier is changed by changing the distance between the brush and the image carrier.

14. The image forming apparatus of claim 10, wherein the control section stops a rotation of the brush in the blade cleaning mode.

15. The image forming apparatus of claim 10, wherein the blade cleaning mode, the control section changes a rotation speed or a rotation direction of the brush.

16. The image forming apparatus of claim 9, wherein a setting of the transfer output comprises a volume of transfer current.

17. The image forming apparatus of claim 9, wherein a setting of the transfer output comprises a polarity of the transfer output.

18. The image forming apparatus of claim 9, wherein the transfer output is stopped as changing a setting of the transfer output.

19. The image forming apparatus of claim 9, wherein the control section determines whether the blade cleaning mode is to be selected or not, based on a coverage rate of the toner image formed on the image carrier or a number of the formed toner image.

* * * * *